US011259981B2

(12) United States Patent
Sarakoglou et al.

(10) Patent No.: US 11,259,981 B2
(45) Date of Patent: Mar. 1, 2022

(54) EXOSKELETON FOR LOWER-LIMBS

(71) Applicants: FONDAZIONE ISTITUTO ITALIANO DI TECNOLOGIA, Genoa (IT); UNIVERSITA'DEGLI STUDI DI GENOVA, Genoa (IT)

(72) Inventors: Ioannis Sarakoglou, Genoa (IT); Lorenzo Saccares, Rome (IT); Nikolaos Tsagarakis, Genoa (IT)

(73) Assignees: FONDAZIONE ISTITUTO ITALIANO DI TECNOLOGIA, Genoa (IT); UNIVERSITA' DEGLI STUDI DI GENOVA, Genoa (IT)

( * ) Notice: Subject to any disclaimer, the term of this patent is extended or adjusted under 35 U.S.C. 154(b) by 193 days.

(21) Appl. No.: 16/339,654

(22) PCT Filed: Oct. 3, 2017

(86) PCT No.: PCT/IB2017/056080
§ 371 (c)(1),
(2) Date: Apr. 4, 2019

(87) PCT Pub. No.: WO2018/065886
PCT Pub. Date: Apr. 12, 2018

(65) Prior Publication Data

US 2020/0038279 A1 Feb. 6, 2020

(30) Foreign Application Priority Data

Oct. 5, 2016 (IT) ..... 102016000099694

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 2003/007* (2013.01); *A61H 2201/165* (2013.01); *A61H 2201/5061* (2013.01)

(58) Field of Classification Search
CPC ..... A61F 2/68; A61F 5/01; B25J 15/10
See application file for complete search history.

(56) References Cited

U.S. PATENT DOCUMENTS

2006/0064047 A1* 3/2006 Shimada ..... A61H 1/0255 602/23
2010/0076360 A1* 3/2010 Shimada ..... A61B 5/1038 602/23

(Continued)

FOREIGN PATENT DOCUMENTS

JP 2006231216 A 9/2006
JP 20050222054 2/2007

(Continued)

OTHER PUBLICATIONS

International Search Report and Written Opinion dated Jan. 17, 2018 for counterpart PCT Application No. PCT/IB2017/056080.

(Continued)

*Primary Examiner* — Yashita Sharma
(74) *Attorney, Agent, or Firm* — Shuttleworth & Ingersoll, PLC; Timothy J. Klima

(57) ABSTRACT

An underactuated exoskeleton for lower-limbs, for supporting the knee of a user, includes a first and a second coupling frame and a movement means associated with the first and with the second frame configured to confer to the second frame a roto-translation movement with respect to the first frame or vice versa. The exoskeleton further includes a junction means operatively interposed between the movement means and the first frame and/or the second frame configured to allow a relative rotation between the first and (Continued)

the second frame in a second plane, orthogonal to the first plane, a rotation of said second frame about said main axis of the leg and a relative translation between the first and the second frame in the second plane.

16 Claims, 4 Drawing Sheets

(56) References Cited

U.S. PATENT DOCUMENTS

| | | | | |
|---|---|---|---|---|
| 2010/0094185 | A1 | 4/2010 | Amundson et al. | |
| 2011/0160626 | A1* | 6/2011 | Takahashi | A61H 3/00 601/34 |
| 2012/0016277 | A1 | 1/2012 | Ebihara et al. | |
| 2014/0358053 | A1 | 12/2014 | Triolo et al. | |
| 2015/0051527 | A1 | 2/2015 | Potter et al. | |
| 2016/0158029 | A1 | 6/2016 | Kuiken et al. | |
| 2016/0184166 | A1* | 6/2016 | Takenaka | A61F 2/60 623/27 |
| 2016/0331624 | A1* | 11/2016 | Sankai | B25J 9/101 |

FOREIGN PATENT DOCUMENTS

| | | | |
|---|---|---|---|
| JP | 2011104035 | A | 6/2011 |
| WO | 2006113520 | A2 | 10/2006 |
| WO | 2013176075 | A1 | 11/2013 |

OTHER PUBLICATIONS

Japanese Office Action dated Aug. 24, 2021 from counterpart Japanese Patent App No. 2019-518214.

Japanese Search Report dated Aug. 27, 2021 from counterpart Japanese Patent App No. 2019-518214.

* cited by examiner

EXOSKELETON FOR LOWER-LIMBS

This application is the National Phase of International Application PCT/IB2017/056080 filed Oct. 3, 2017 which designated the U.S.

This application claims priority to Italian Patent Application No. 102016000099694 filed Oct. 5, 2016, which application is incorporated by reference herein.

The subject matter of the present invention is an exoskeleton for lower-limbs. More in particular, the present invention relates to an exoskeleton for lower-limbs modelled as a system with six degrees of freedom, underactuated and self-aligning. Exoskeletons for lower-limbs have different applications that range from rehabilitation to assistance and increasing the power of a user.

Exoskeletons for rehabilitation aim to recover the neuromuscular functions of patients affected by strokes or that have undergone surgery. Non-portable devices are usually available which are therefore segregated to use in clinics.

Exoskeletons for assistance aim to partially or fully support the movement of individuals with altered functions, while they perform everyday tasks.

Exoskeletons for increasing power aim to increase the muscular strength and/or resistance of a healthy user, while they are lifting and transporting heavy loads.

In the design of these exoskeletons there are different problems connected with technological limits such as, for example, the actuation or the materials used. There are also problems of comfort and ergonomics that can make the exoskeletons unsuitable for real-life applications.

Exoskeletons must therefore be able to guarantee appropriate coupling kinematics between the mechanical articulations of the devices and human joints.

To obtain appropriate coupling kinematics, no constraints must be imposed by the exoskeleton on the user's movements. Such constraints could make sliding movements occur between the user's leg and the fastenings of the exoskeleton, leading to uncomfortable or even painful situations.

The exoskeleton, associated with the user's knee, must further be modelled like a system with six degrees of freedom and must be able to allow the internal/external rotation of the tibia, and lateral rotation.

The flexion/extension rotation of the knee must be uncoupled from the other modelled movements, otherwise there would be misalignment problems between the axis of rotation of the knee joints and those of the exoskeleton.

An objective of this invention is that of providing an exoskeleton for lower-limbs that allows the problems that have emerged in the prior art to be solved.

In more detail, an objective of this invention is to provide an exoskeleton for lower-limbs, modelled as a system with six degrees of freedom, underactuated and self-aligning, configured to transmit a twisting moment to assist the flexion/extension motion of the knee of a user.

The stated technical task and specified objects are substantially achieved by an exoskeleton for lower-limbs, comprising the technical features disclosed in one or more of the appended claims.

In particular, the underactuated exoskeleton for lower-limbs for supporting the knee of a user, according to the present invention comprises a first coupling frame provided with upper attaching means configured to be joined to a thigh of a user and a second coupling frame provided with a lower attaching means configured to be joined to a corresponding leg of a user extending along its own main axis. The exoskeleton further comprises a movement means associated with said first and said second frame and configured to impart to said second frame a roto-translation movement with respect to the first frame or vice versa.

According to an aspect of the present invention, the movement means comprises a rotary actuation unit and a motion transmission unit operatively interposed between said rotary actuation unit and said first or second frame.

In other words, the rotary actuation unit may be associated with the first frame allowing a roto-translation movement to be transmitted to said second frame with respect to the first frame by means of the motion transmission unit.

When the rotary actuation unit is associated with the second frame, it allows a roto-translation movement of the first frame with respect to the second frame, by means of the motion transmission unit.

Preferably, said movement means is configured to transform a twisting moment imparted by the rotary actuation unit into a first roto-translation of the first or second frame in a first flexion/extension plane of the knee.

The transmission unit is operatively active only in one or more planes parallel to the first flexion/extension plane of the knee.

Preferably the transmission unit is made in the form of a Schmidt coupling.

It is to be noted that the term flexion/extension plane means a transverse plane with respect to the thigh of the user, in which the leg can bend or extend.

According to a further aspect of the present invention, the exoskeleton comprises a joint means operatively interposed between said movement means and said first frame and/or said second frame.

The joint means is configured to allow a roto-translation, between said first and second frame, in a second plane, orthogonal to the first flexion/extension plane, and a rotation of said second frame about said main axis of the leg.

Preferably, the joint means is provided with a first rotational joint, configured to allow a relative rotation between said first and second frame in a second plane, orthogonal to said first plane.

Preferably, the joint means is provided with a second rotational joint, configured to allow a rotation of said second frame about said main axis of the leg.

Preferably, the joint means is provided with a third joint, rotatably or linearly yieldable in said second plane, to allow, in combination with said first joint, a relative translation between said first and second frame in said second plane.

Preferably, to allow said translation, the third joint (especially if rotational) cooperates, in addition to with the first joint, also with the transmission unit, which by promoting the distancing of the first frame from the second creates the useful distance for transforming the pure rotation of the joint into a translation.

Advantageously, the above-mentioned elements allow the exoskeleton to be modelled as a system with six degrees of freedom.

Furthermore, the structure thus described allows the exoskeleton to be made into an underactuated system.

Advantageously, the exoskeleton described above is self-aligning.

Furthermore, the exoskeleton is comfortable and not bulky for a user.

Further characteristics and advantages of the present invention will become more apparent from the indicative and thus non-limiting description of a preferred, but not exclusive, embodiment of an exoskeleton for lower-limbs. This description will be explained below with reference to the appended drawings, provided solely for indicative and therefore non-limiting purposes, in which.

Figure 5:
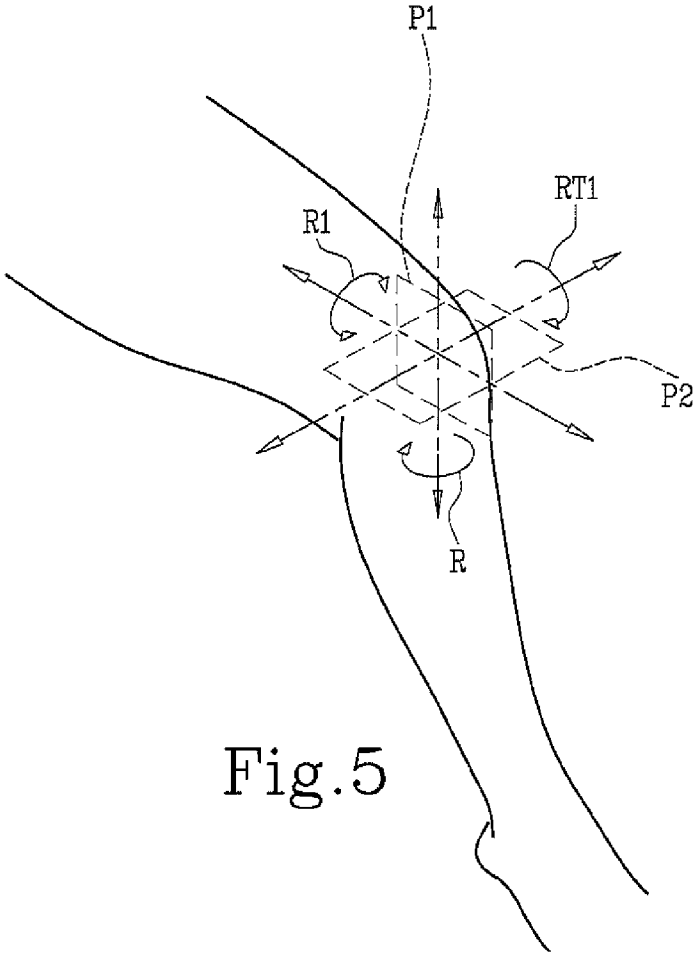
Figure 4:
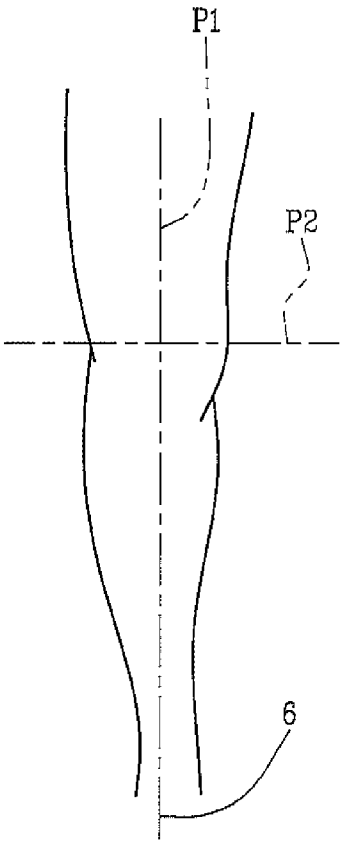

FIGS. 4 and 5 schematically represent the movement planes of the exoskeleton in relation to the knee of the user.

With reference to the appended figures, 1 indicates overall an underactuated and self-aligning exoskeleton for lower-limbs, configured to support a knee of a user, which for simplicity purposes will be indicated below as exoskeleton 1. The common elements among the various embodiments illustrated in the appended figures have been indicated with the same reference number.

Figure 1:
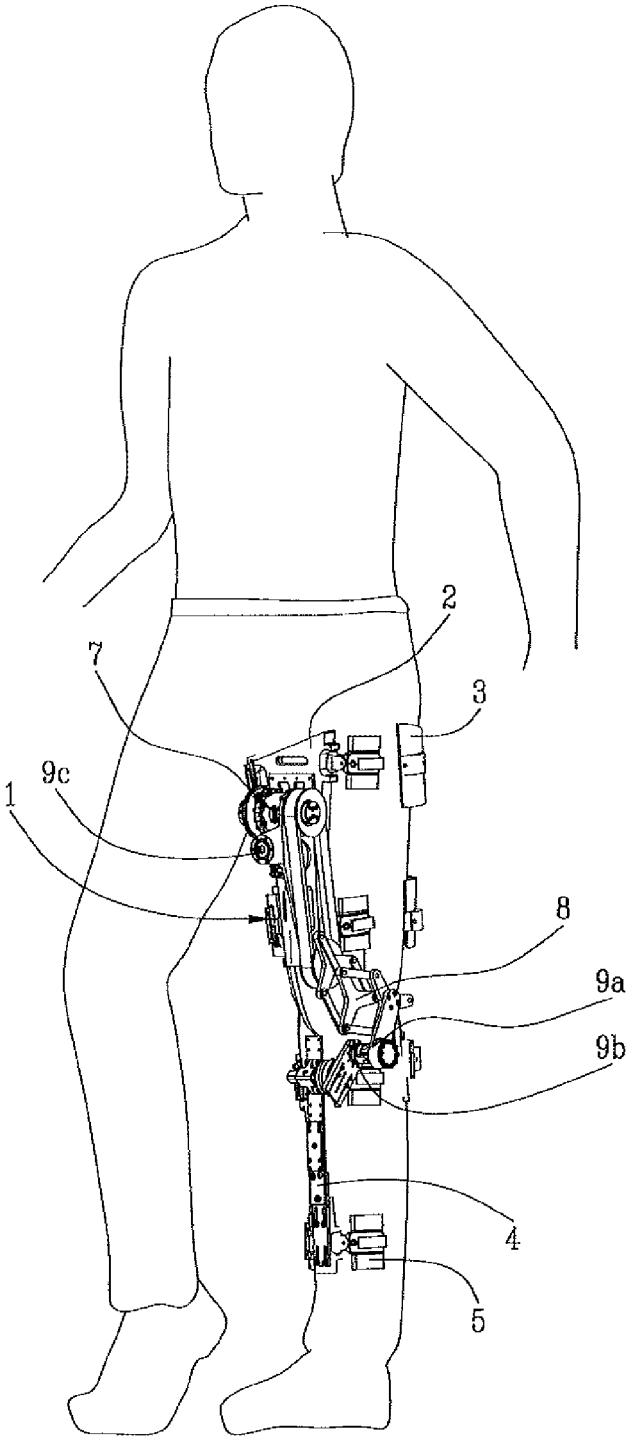
FIG. 1 is a schematic representation of an exoskeleton for lower-limbs worn by a user.

FIG. 1 illustrates an exoskeleton 1 worn by a user. The exoskeleton 1 is underactuated, i.e. it is a system with six degrees of freedom in which there is only one actuated degree of freedom while the remaining five are passive with respect to the first.

As illustrated in FIG. 1, the exoskeleton 1 is worn by a user on a leg, more in particular it is worn for supporting a knee of the user.

The exoskeleton 1 comprises a first coupling frame 2 provided with upper attaching means 3 configured to be joined to a thigh of the user.

The first frame 2 is structured to be associated with the thigh of the user. In particular, the first frame 2 and the upper attaching means 3 are designed not to be bulky for or to bother the wearer.

The exoskeleton 1 further comprises a second coupling frame 4 provided with lower attaching means 5 configured to be joined to a corresponding leg of the user. The second frame 4 extends along its own main axis 6.

The second frame 4 is structured to be associated with the leg of the user, following its own main axis 6. In particular, the second frame 4 and the lower attaching means 5 are designed not to be bulky for or to bother the wearer.

A movement means is interposed between the first frame 2 and the second frame 4, configured to confer to the second frame 4 a roto-translation movement with respect to the first frame 2.

This movement means may be associated with the first frame 2 to set the second frame 4 in motion, or vice versa.

In other words, in an embodiment not illustrated, it may be configured to confer to the first frame 2 a roto-translation movement with respect to the second frame 4, but as the first frame 2 is associated with the thigh of the user, it is the second frame 4 that performs the roto-translation movement (unless the user is sitting down).

For descriptive simplicity, but without reducing the generality, reference will be made below to the preferred embodiment in which the movement means is associated with the first frame 2.

The movement means comprises a rotary actuation unit 7 and a transmission unit 8 for transmitting motion operatively interposed between the rotary actuation unit 7 and the first frame 2.

The rotary actuation unit 7 comprises a motor 7*a* connected to the transmission unit 8.

Preferably, the rotary actuation unit 7 also comprises a flexible transmission element 7*b* interposed between the motor 7*a* and the transmission unit 8.

Alternatively, the rotary actuation unit 7 may not be provided with the flexible transmission element 7*b* and therefore may comprise, in an embodiment not illustrated, a motor 7*a* directly connected to the transmission unit 8. Advantageously this solution leads to a more comfortable situation for the user, both in terms of weight and size.

The transmission unit 8 is configured to transform a twisting moment imparted by the rotary actuation unit 7 into a first roto-translation "RT1" of the second frame 4 in a first flexion/extension plane "P1" of the knee.

In particular, the transmission unit 8 is operatively active only in one or more planes parallel to the first flexion/extension plane "P1" of the knee.

The flexion/extension plane "P1" means a plane being transverse to the user's thigh, in which the main movement of the second frame 4 with respect to the first 2 takes place (i.e. in which the leg can bend or extend).

With reference to FIG. 4, the first flexion/extension plane "P1" is the plane in which the leg performs the flexion and extension movement, in particular it is a transverse plane to the thigh of the user. The flexion and extension movement is that relative to the active degree of freedom in the exoskeleton.

FIG. 4 further illustrates a second plane "P2", orthogonal to the first plane "P1" which, in the extended condition of the leg, is substantially vertical.

The second plane "P2" comprises an axis of rotation 6, with the relative translations and rotations associated therewith.

In particular, in the second plane "P2" and in the axis of rotation 6 all the roto-translations not inherent to the plane "P1" are possible.

The exoskeleton 1 further comprises a joint means 9 operatively interposed between the movement means and the first 2 and the second frame 4.

The joint means 9 is configured to allow translations and rotations relative to the first plane "P1" and to the second plane "P2" described in FIG. 4.

More in detail, the joint means 9 is configured to allow a second roto-translation between the first 2 and the second frame 4, in the second plane "P2" orthogonal to the first plane "P1". The joint means 9 is further configured to allow a rotation "R" of the second frame 4 about the main axis 6 of the leg.

In particular the joint means 9 comprises a first rotational joint 9*a*, configured to allow a relative rotation "R1" between the first 2 and the second frame 4 in the second plane "P2", orthogonal to the first plane "P1".

The joint means 9 further comprises a second rotational joint 9*b*, configured to allow a rotation "R" of said second frame 4 about said main axis 6 of the leg.

The joint means 9 further comprises a third joint 9*c*, rotatably or linearly yieldable in said second plane, to allow, in combination with said first joint 9*a* and with said transmission unit, a relative translation "T2" between said first 2 and second frame 4 in said second plane "P2".

Figure 2:
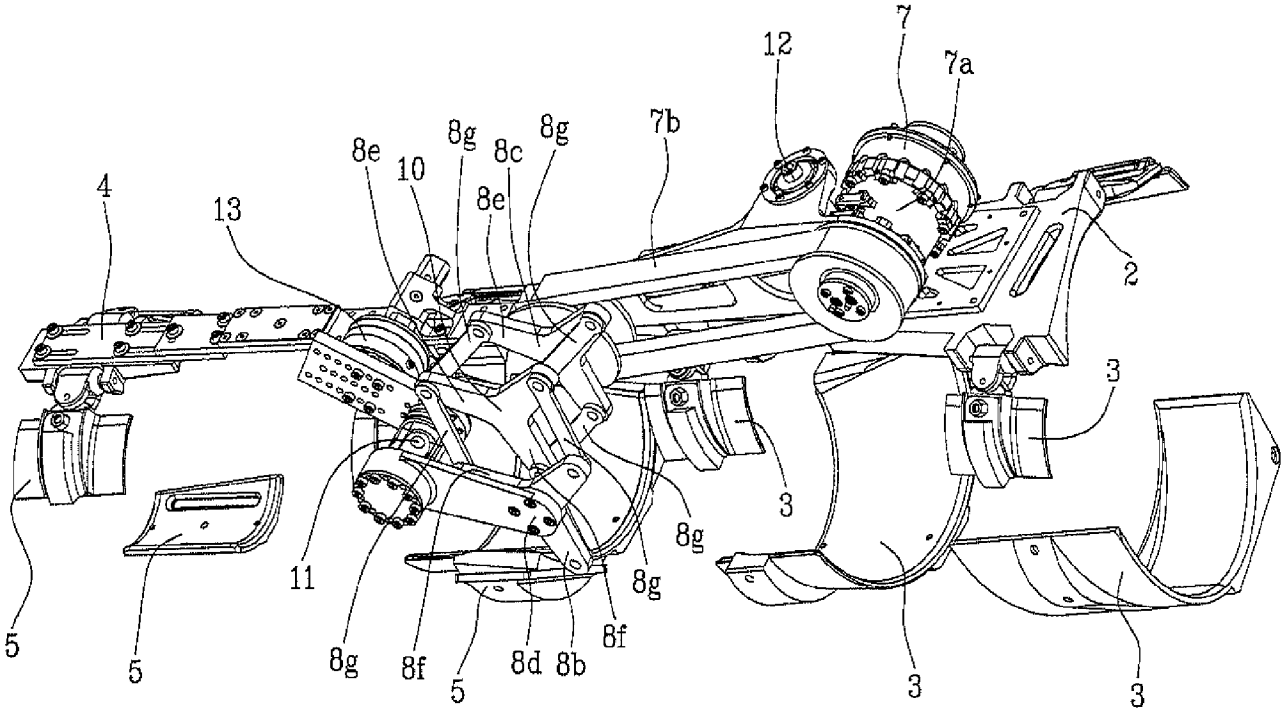
FIG. 2 is a schematic representation of an exoskeleton for lower-limbs according to a first embodiment thereof.

With reference to FIG. 2, for example, to obtain a lateral translation the third joint 9*c* cooperates synergically with the first joint 9*a* and with the transmission unit 8.

In other words, in a first embodiment, the third joint 9*c* is configured to guarantee a degree of rotational freedom to the first frame 2 with respect to the second 4, or vice versa.

Such degree of rotational freedom is preferably a rotation about an axis orthogonal to the second plane "P2".

It is to be noted that, in such embodiment, such rotation, together with the translation permitted by the transmission unit 8 in the first plane "P1", allows a translation of the second frame 4 in the second plane "P2".

In other words, the third joint 9*c* being of the exclusively rotational type, the translation in said second plane "P2" is allowed thanks to the variation of an arm (or distance) between the first 2 and the second frame 4 (in the first plane "P1") obtained by means of the transmission unit 8.

Alternatively, the third joint 9*c* can be configured to allow a translation, i.e. linear sliding, between the first 2 and the second frame 4.

Advantageously, the combination of the joint means 9 therefore allows the exoskeleton 1 to perform all the necessary movements to be efficient in its task as a supporting exoskeleton.

Furthermore, as will be described below in FIGS. 2 and 3, the combination of the joint means and the movement means will create combinations such as to allow the exoskeleton to be self-aligning and therefore not to have undesired relative translations between the knee and the exoskeleton 1.

In detail, FIG. 2 illustrates the exoskeleton 1 in a first embodiment thereof.

In this embodiment the rotary actuation unit 7 is connected to the first frame 2 and is operatively connected to the transmission unit 8.

The transmission unit 8 comprises at least one first body 8*a*, associated with the actuation unit 7, and a second body 8*b*, associated with the first frame 2 or with the second frame 4. In the embodiment of FIG. 2 reference will be made to the case in which the second body 8*b* is associated with the second frame 4.

The second body 8*b* can translate freely with respect to the first body 8*a* and is rotatably constrained thereto. This means that, in plane "P1", the second body 8*b* is free to move but having to respect the rotation constraint imposed by the first body 8*a*.

The transmission unit 8 further comprises a first articulated joint 8*c*, comprising the first body 8*a*, and a second junction 8*d*, comprising the second body 8*b*.

"Articulated junction" means a junction generally provided with a plurality of elements hinged and/or connected to each other through arms defining, in the junction points, articulations.

In this case, the articulations are conformed to move in the first plane "P1" defining the roto-translations connected with the extension and flexion movement.

The first 8*c* and the second articulated junction 8*d* each comprise an inlet element 8*e* and an outlet element 8*f*. The inlet element 8*e* and the outlet element 8*f* are connected to each other through leverages 8*g*.

The outlet element 8*f* of the first articulated junction 8*c* corresponds to the inlet element 8*e* of the second articulated junction 8*d*.

Inlet and outlet mean the elements by which the flexion or extension movement is transmitted and received, respectively.

In the preferred embodiment, the first 8*c* and the second articulated junction 8*d* define a Schmidt coupling 10.

The Schmidt coupling 10 is a mechanism with three degrees of freedom that allows a rotation to be transmitted between an inlet member (preferably a disc) and an outlet member 8*f* (preferably a disc) whose axes of rotation have a certain radial distance through a further member (preferably a disc).

With reference to the above, the inlet member is the inlet element 8*e* of the first articulated junction 8*c*, the outlet member is the outlet element 8*f* of the second articulated junction 8*d* and the further member defines both the outlet element 8*f* of the first articulated junction 8*c* and the inlet element 8*e* of the second articulated junction 8*d*.

The Schmidt coupling 10 is further able to uncouple the relative rotation of the inlet/outlet members from their translations.

The flexion extension movement is transmitted to the transmission unit 8, by means of a flexible transmission means 7*b*, preferably in the form of a belt or a chain.

Alternatively, the articulated junctions 8*c* and 8*d* can be defined by a series of two articulated parallelograms, in both cases planar with respect to the first plane "P1".

Preferably, a first parallelogram comprises a first lever, defining the inlet element, a second lever, defining the outlet element, and two connection arms hinged to both (defining the leverages).

Furthermore, a second parallelogram, placed in series with the first, comprises a first lever, defining the inlet element, a second lever, defining the outlet element, and two connection arms hinged to both (defining the leverages).

The second lever of the first parallelogram is rotatably constrained to the first lever of the second parallelogram; therefore said levers define a transmission member for transmitting rotational motion between the two parallelograms.

Alternatively, the first 8*a* and the second body 8*b* are defined by discs rotatable about respective parallel axes of rotation and are slidably coupled to one another.

In particular, the transmission unit thus described comprises a further shaped disc interposed between the first and the second body 8*a* and 8*b* to define an Oldham coupling.

Preferably, also in the case of the series of two parallelograms and the Oldham coupling, the transmission unit 8 is connected with a belt.

Alternatively, however, the rotary actuation unit 7 is directly connected to the transmission unit 8 and therefore does not have the transmission means 7*b*. This solution leads to a more comfortable situation for the user, both in terms of weight and size.

The joint means is configured to allow translations and rotations relative to the first plane "P1" and to the second plane "P2" and to the main axis 6 of the leg.

The first joint 9*a* and the second joint 9*b* are connected to each other in series to define a universal joint 11 operatively interposed between the transmission unit 8 and the second frame 4.

The third joint 9*c* is made in the form of a pin 12, perpendicular to the second plane "P2" and operatively interposed between the first frame 2 and the rotary actuation unit 7.

This configuration is able to allow the second roto-translation between the first 2 and the second frame 4 and allows the rotation "R" of the second frame 4 about the main axis 6 of the leg.

The exoskeleton 1 further comprises a sensor 13 operatively interposed between the universal joint 11 and the second frame 4. The sensor 13 is configured to detect a force or a torque transmitted between the first 2 and the second frame 4. In particular, the sensor 13 has the aim of monitoring the forces and the torques that are transmitted by the exoskeleton 1 between the thigh and the leg.

Preferably, the sensor 13 is a force and torque sensor. More in particular it is an ATI® 45 mini force-torque sensor.

Figure 3:
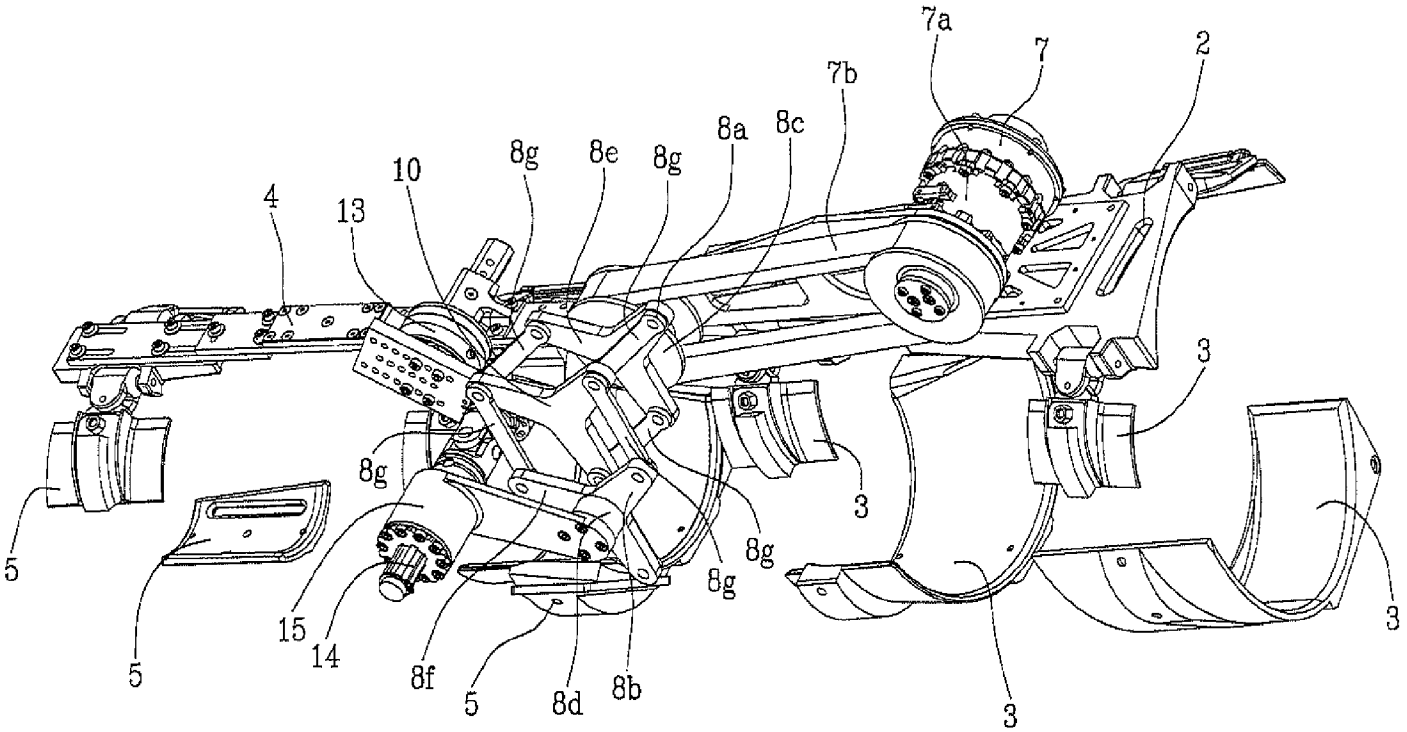
FIG. 3 is a schematic representation of an exoskeleton for lower-limbs according to a second embodiment thereof.

FIG. 3 illustrates the exoskeleton 1 in a second embodiment thereof, in which the third joint 9*c* comprises a grooved pin 14 slidably associated with a respective grooved sleeve 15.

The third joint 9*c* thus created is operatively interposed between the transmission unit 8 and the second frame 4.

In particular, the third joint 9*c* is operatively interposed between the transmission unit 8 and the universal joint 11.

The exoskeleton 1, as described in its non-limitative embodiments, is modelled as an underactuated system with 6 degrees of freedom. The structure is also self-aligning, thus making the relative rotation of the exoskeleton completely independent, with respect to the flexion/extension axis of rotation of the knee, from the other rotations and translations. In this way, the creation of undesired force/twisting moment interactions between the attachments of the exoskeleton and the leg of the user is prevented.

The exoskeleton is further configured to transmit a twisting moment to assist the flexion/extension motion of the knee of a user. More in particular, taking for example the first embodiment, the combination between the rotary actuation unit 7 and the Schmidt coupling 10 with the universal joint 11 and the pin 12, allows a pure twisting moment to be transmitted while relative translations are accommodated.

The universal joint 11 further guarantees that the exoskeleton does not collapse under the force of gravity.

More precisely, it is the interaction between the universal joint 11 and the transmission unit 8 (preferably the Schmidt coupling 10) that guarantees that the exoskeleton does not collapse under the force of gravity.

The exoskeleton 1 thus structured is also comfortable to wear for the user and is not very bulky. In particular, in the two embodiments illustrated above, the exoskeleton 1 is structured so that the first frame 2 associated with the leg of the user and the second frame 4 associated with the leg of the user are not bulky and cannot cause pain or bother to the user.

The invention claimed is:

1. An underactuated exoskeleton for lower-limbs, for supporting a knee of a user, comprising:

a first coupling frame including an upper attaching surface configured to be joined to a thigh of the user;

a second coupling frame including a lower attaching surface configured to be joined to a corresponding leg of the user and extend along a main axis of the leg;

a movement device connected to said first coupling frame and said second coupling frame and configured to give said second coupling frame a roto-translation movement with respect to said first coupling frame or vice versa; wherein said movement device includes:

a rotary actuation unit, a motion transmission unit operatively interposed between said rotary actuation unit and said first coupling frame or said second coupling frame configured to transform a twisting moment imparted by said rotary actuation unit into a first roto-translation of said first coupling frame or said second coupling frame in a first plane of flexion/extension of said knee;

a joint device operatively interposed between said movement device and said first coupling frame and/or said second coupling frame, the joint device including:

a rotational first joint, configured to allow a relative rotation between said first coupling frame and said second coupling frame with respect to a second plane, orthogonal to said first plane;

a rotational second joint, configured to allow a rotation of said second coupling frame about said main axis of the leg;

a third joint, rotatably or linearly yieldable in said second plane, to allow, in combination with said first joint and with said motion transmission unit, a relative translation between said first coupling frame and said second coupling frame in said second plane.

2. The exoskeleton for lower-limbs according to claim 1, wherein said motion transmission unit is operatively active only in one or more planes parallel to said first plane of the knee.

3. The exoskeleton for lower-limbs according to claim 1, wherein said motion transmission unit comprises a first body associated with the rotary actuation unit, and a second body, associated with said first coupling frame or said second coupling frame, wherein, in said first plane, said second body translates with respect to the first body and is rotatably constrained thereto.

4. The exoskeleton for lower-limbs according to claim 3, wherein said motion transmission unit comprises a first articulated junction, comprising said first body, and a second articulated junction, comprising said second body.

5. The exoskeleton for lower-limbs according to claim 4, wherein each of the first and second articulated junctions comprises an inlet element and an outlet element connected to one another through leverages; said outlet element of the first articulated junction corresponding to the inlet element of the second articulated junction.

6. The exoskeleton for lower-limbs according to claim 4, wherein said first and second articulated junctions define a Schmidt coupling or a series of two articulated parallelograms.

7. The exoskeleton for lower-limbs according to claim 3, wherein said first body and said second body are defined by discs rotatable about respective parallel axes of rotation and are slidably coupled to one another.

8. The exoskeleton for lower-limbs according to claim 7, comprising a further shaped disc interposed between said first body and said second body for defining an Oldham coupling.

9. The exoskeleton for lower-limbs according to claim 1, wherein said first joint and said second joint are connected to one another in series for defining a universal joint operatively interposed between said motion transmission unit and said second coupling frame.

10. The exoskeleton for lower-limbs according to claim 1, wherein the third joint includes a pin, perpendicular to said second plane and operatively interposed between said first coupling frame and said rotary actuation unit.

11. The exoskeleton for lower-limbs according to claim 1, wherein the third joint comprises a grooved pin slidably connected with a respective grooved sleeve, and is operatively interposed between said motion transmission unit and said second coupling frame.

12. The exoskeleton for lower-limbs according to claim 11, wherein said rotary actuation unit is rigidly connected to said first coupling frame.

13. The exoskeleton for lower-limbs according to claim 1, wherein said rotary actuation unit comprises:

a motor;

a flexible transmission element interposed between said motor and said motion transmission unit.

14. The exoskeleton for lower-limbs according to claim 13, wherein said flexible transmission element is a belt or a chain.

15. The exoskeleton for lower-limbs according to claim 1, wherein said rotary actuation unit comprises a motor directly connected to said motion transmission unit.

16. The exoskeleton for lower-limbs according to claim 9, further comprising a sensor operatively interposed between said universal joint and said second coupling frame and configured to detect a force or a torque transmitted between said first coupling frame and said second coupling frame.

* * * * *